US008720542B2

(12) United States Patent
Hughes et al.

(10) Patent No.: US 8,720,542 B2
(45) Date of Patent: May 13, 2014

(54) TUBULAR HANDLING DEVICE

(75) Inventors: Paul Anthony Hughes, Lancaster (GB); Faisal J. Yousef, Houston, TX (US)

(73) Assignees: First Subsea Limited, Lancaster (GB); Canrig Drilling Technology Ltd, Houston, TX (US)

( * ) Notice: Subject to any disclaimer, the term of this patent is extended or adjusted under 35 U.S.C. 154(b) by 289 days.

(21) Appl. No.: 13/001,301

(22) PCT Filed: Jun. 26, 2009

(86) PCT No.: PCT/GB2009/050741
§ 371 (c)(1),
(2), (4) Date: Dec. 23, 2010

(87) PCT Pub. No.: WO2009/156764
PCT Pub. Date: Dec. 30, 2009

(65) Prior Publication Data

US 2011/0259577 A1 Oct. 27, 2011

Related U.S. Application Data

(63) Continuation-in-part of application No. 12/147,223, filed on Jun. 26, 2008, now Pat. No. 8,074,711.

(51) Int. Cl.
*E21B 19/10* (2006.01)

(52) U.S. Cl.
USPC ..... 166/77.51; 166/77.52; 166/77.53; 166/98; 166/380

(58) Field of Classification Search
USPC ..... 166/77.1, 77.51, 77.52, 77.53, 98, 166/379–380; 188/67
See application file for complete search history.

(56) References Cited

U.S. PATENT DOCUMENTS 1,532,979 A 4/1925 Russell
2,012,329 A * 8/1935 Wickersham et al. ..... 188/67

(Continued)

FOREIGN PATENT DOCUMENTS

WO 2004067854 12/2004
WO 2008085700 7/2008

OTHER PUBLICATIONS

PCT/GB2009/050741, International Preliminary Report on Patentability, issued Jan. 5, 2011, 7 pages.

(Continued)

*Primary Examiner* — James Sayre
(74) *Attorney, Agent, or Firm* — Meunier Carlin & Curfman, LLC

(57) ABSTRACT

A tubular member handling apparatus is a gripping tool (100) in the form of a body (110) having a longitudinal axis (202) and formed by a plurality of sleeves (750) connected end to end, each sleeve including a frusto-conical bore 752 centered on said longitudinal axis; a clamp member (700) in each sleeve formed by clamp-segments (740), each having side faces (168), end faces (743), a frusto-conical exterior surface (741) adapted to match said frusto-conical bore, and a cylindrical interior surface (745); cage-segments (220) connected to said interior surface and having a plurality of windows (222) partially closing recesses (214) in said interior surface, which recesses are elongate in said longitudinal direction, house a roller (230) and have a base (236) inclined in said longitudinal direction so that, at a lower end (232) of each recess the roller protrudes through said window and at an upper end (234) thereof the roller protrudes less or not at all; a bias mechanism 780, urging said clamp-segments apart from each other in a peripheral direction; connection means (160) between adjacent clamp segments so that they move together when one is moved axially.

25 Claims, 4 Drawing Sheets

(56) References Cited

U.S. PATENT DOCUMENTS

| | | | | |
|---|---|---|---|---|
| 2,221,376 | A | 11/1940 | Fortune et al. | |
| 2,736,941 | A | 3/1956 | Mullinix | |
| 3,019,502 | A * | 2/1962 | Walker, Jr. | 188/67 |
| 4,715,625 | A * | 12/1987 | Shows et al. | 285/123.11 |
| 5,967,477 | A * | 10/1999 | Walmsley | 248/230.2 |
| 5,992,801 | A | 11/1999 | Torres | |
| 6,305,649 | B1 * | 10/2001 | Walmsley et al. | 248/49 |
| 6,644,413 | B2 * | 11/2003 | Adams et al. | 166/382 |
| 8,186,246 | B2 * | 5/2012 | Niven | 81/57.16 |
| 2004/0084191 | A1 * | 5/2004 | Laird | 166/387 |
| 2005/0160881 | A1 | 7/2005 | Niven | |

OTHER PUBLICATIONS

International Search Report for International Application Na PCT/GB2009/050741. European Patent Office. pp. 1-2. Dated Oct. 16, 2009.

* cited by examiner

FIG. 4α

TUBULAR HANDLING DEVICE

CROSS REFERENCE TO RELATED APPLICATIONS

This application is a national stage entry of PCT/GB2009/050741 filed on Jun. 26, 2009, which is a continuation-in-part and claims priority to U.S. patent application Ser. No. 12/147,223 filed on Jun. 26, 2008.

This invention relates to a device for handling circular cylindrical tubular objects, with or without intervening bulges or flanges at their ends or intermediate their length. Furthermore it relates to a device that can grip such a tubular object not just for the purpose of lifting the object (in a direction including vertically upwardly in a direction parallel a longitudinal axis of the object), but also for the purpose of applying torque to the object about said longitudinal axis.

BACKGROUND

The drilling of subterranean wells involves assembling tubular strings, such as casing strings and drill strings, each of which comprises a plurality of heavy, elongated tubular segments extending downwardly from a drilling rig into a wellbore. The tubular string consists of a number of threadedly engaged tubular segments.

Conventionally, workers use a labor-intensive method to couple tubular segments to form a tubular string. This method involves the use of workers, typically a "stabber" and a tong operator. The stabber manually aligns the lower end of a tubular segment with the upper end of the existing tubular string, and the tong operator engages the tongs to rotate the segment, threadedly connecting it to the tubular string. While such a method is effective, it is dangerous, cumbersome and inefficient. Additionally, the tongs require multiple workers for proper engagement of the tubular segment and to couple the tubular segment to the tubular string. Thus, such a method is labour-intensive and therefore costly. Furthermore, using tongs can require the use of scaffolding or other like structures, which endangers workers.

Others have proposed a running tool utilizing a conventional top drive assembly for assembling tubular strings. The running tool includes a manipulator, which engages a tubular segment and raises the tubular segment up into a power assist elevator, which relies on applied energy to hold the tubular segment. The elevator couples to the top drive, which rotates the elevator. Thus, the tubular segment contacts a tubular string and the top drive rotates the tubular segment and threadedly engages it with the tubular string.

While such a tool provides benefits over the more conventional systems used to assemble tubular strings, it also suffers from shortcomings. One such shortcoming is that the tubular segment might be scarred by the elevator gripping dies. Another shortcoming is that a conventional manipulator arm cannot remove single joint tubulars and lay them down on the pipe deck without worker involvement.

Other tools have been proposed to cure these shortcomings. However, such tools are often unable to handle tubulars that are dimensionally non-uniform. When the tubulars being handled are not dimensionally ideal, such as by having a varying wall thickness or imperfect circularity of tube section, the ability of tools to adequately engage the tubulars is decreased.

There are many other circumstances in which it is desirable to handle other tubular objects. Indeed, the general handling of large pipe sections can be problematic, and a convenient tool for grabbing and loading pipes is desirable. Indeed, very large pipe sections (with a weight in the order of 6000 kN) are frequently provided with lifting and handling handles, but these generally require personnel to ensure appropriate hook up and disconnect. It would be desirable if a pipe could be provided with a simple mechanism for safe connection and disconnection of a lifting device that did not require human intervention at the site of connection. Of course, much smaller pipe sections might be provided with such lifting arrangements.

Floor slips are employed on production sites to hold casings and drill pipes being lowered into a well while a new length is connected to the top of the pipe or casing being held. An appropriate design of holder that did not need to open to allow flanges and the like on the casings and drill pipes to navigate through the floor slip, as well as not requiring human intervention in the immediate vicinity of the floor slip during holding and release operations, would be desirable.

Emergency disconnect packages are employed to connect rigid risers from subsea installations to surface vessels. Such vessels generally dynamically hold position above a riser but adverse weather conditions and sometimes an inability to maintain position require the possibility of an emergency disconnection from the riser. A device capable performing such function is desirable.

PRIOR ART

WO2008/085700 discloses a tubular handling apparatus, comprising: a slotted member having a plurality of elongated slots each extending in a direction; a recessed member slidably coupled to the slotted member and having a plurality of recesses each tapered in the direction from a shallow end to a deep end; and a plurality of rolling members each retained between one of the recesses and one of the slots; wherein each rolling member partially extends through the adjacent slot when located in the shallow end of the recess; and wherein each rolling member retracts within an outer perimeter of the slotted member when located in a deep end of the recess. Such apparatus is useful in gripping to both internal and external surfaces of tubulars. However, if the tubular has peripheral extensions then the slotted member cannot necessarily move over such extensions during positioning of the apparatus on the tubular.

WO2004/067854 discloses a tool for gripping a tubular object by contact with opposed surfaces thereof comprising a mandrel having means for attachment to lifting gear, at least one pair of gripping assemblies attached to the mandrel, each gripping assembly comprising a body member, a wedge member slidably movable on an individual ramp with respect to the body member towards and away from the mandrel, and a ball or roller cage slidably movable with respect to the wedge member and having at least one ball or roller movable with the ball or roller cage on an inclined ramp with respect to the wedge member thus to grip one of said opposed surfaces of the tubular object to be gripped. An annular array of such gripping assemblies may be attached to the mandrel, each with a wedge member and a ball or roller cage, such that each ball or roller is caused to make annular contact with the wall surface of the object of circular section. Such an arrangement is complex. Moreover, torque cannot be applied through the tool to the object gripped by it. However, it also discloses a plurality of arrays, one above the other.

US2005/0160881 discloses a clamping mechanism for applying torque, having two or more jaws that may be opened to allow a tubular to be introduced within the jaws and closed to retain the tubular therewithin. Rollers are located within concave recesses and maintained in spaced apart relationship by biasing means, whereby rotation of tubular may cause the rollers to be wedged between a wall of the recess and the tubular to grip the tubular within the jaws. The clamping mechanism may be utilized as an oil field tubular clamp, a slip, a pipe clamp, and other mechanisms. There is also disclosed a clutch comprising an outer race, a cage, and an inner ring. Recesses are provided in an outer race and accommodate rollers therewith and maintained in spaced apart relationship by the cage.

It is an object of the present invention to provide a relatively simple structure that is not only capable of lifting, but also of applying torque when desired.

It is another object to provide a device that is capable of permitting large diameter sections of tubular to pass through the device when it is in a release condition without it having to be opened and removed from the tubular.

It is a further object to provide a device that can be released rapidly from, and with less force than the clamping force applied by the device in, its locked condition.

SUMMARY OF THE INVENTION

In accordance with the present invention there is provided a gripping tool in the form of a body having a longitudinal axis and formed by a plurality of sleeves connected end to end, each sleeve including a frusto-conical bore centered on said longitudinal axis;

- a clamp member in each sleeve formed by clamp-segments, each having side faces, end faces, a frusto-conical exterior surface adapted to match said frusto-conical bore, and a cylindrical interior surface;
- cage-segments connected to said interior surface and having a plurality of windows partially closing recesses in said interior surface, which recesses are elongate in said longitudinal direction, house a roller and have a base inclined in said longitudinal direction so that, at a lower end of each recess the roller protrudes through said window and at an upper end thereof the roller protrudes less or not at all;
- a bias mechanism, urging said clamp-segments apart from each other in a peripheral direction;
- connection means between adjacent clamp segments so that they move together when one is moved axially.

Preferably, said connection means is a bolt passing longitudinally through all longitudinally aligned clamp-segments and clamping them together axially.

Preferably, a top one each of said clamp-segments has a lift eye by which said clamp elements may be lifted with respect to said sleeves so that said clamp-segments slide up said frusto-conical bore separating from one another in a peripheral direction as they progress.

Preferably, a key on one of said frusto-conical surfaces slides in a groove in the other of said frusto-conical surfaces whereby torque applied to said sleeves is transmitted to said clamp-segments. Preferably, said key and slot are parallel the cone angle of said frusto-conical surfaces.

Preferably, said key and slot are central in said clamp-segment between said side faces. Preferably, there are three clamp-segments.

Preferably, said side faces are planar and disposed in radial planes with respect to said longitudinal axis. Preferably, between a clamp position and an open position of the tool, the segments move from position in which the arcs of the cage segments lie in a common cylindrical surface and the frusto-conical surfaces are flush with each other, to a release position in which said side faces are spaced from one another and said frustoconical surfaces have only line contact between them.

Alternatively, said frusto-conical surfaces are inclined part-cylindrical surfaces.

Preferably, said sleeves are seated in a hollow housing tube. The tube and sleeves may have between them a key whereby torque applied to the housing is transmitted to said sleeves. Said housing may have a cylindrical bore with an internal ledge at its bottom end, said sleeves being loaded from a top end, a bottom one seating on said ledge and succeeding ones seating on the one below.

Preferably, said rollers are balls and said recesses have a semi-circular base of diameter substantially equal to the diameter of the balls.

Preferably, said bias mechanism comprises a spring between each facing side face of adjacent clamp-segments.

Thus, when said lifting eyes are each attached to a lifting cable that lifts the clamp segments, the segments separate sufficiently to release any tubular clamped between the clamp-segments. That is to say, preferably the angle of inclination with respect to the longitudinal axis of the frusto-conical surfaces is greater than the angle of inclination of the recess bases. The latter is preferably between 3 and 10 degrees, preferably between 5 and 8 degrees. The former is preferably between 10 and 20 degrees, and more preferably between 13 and 16 degrees.

Preferably, the tool is designed to clamp on tubular members whose diameter is such that, when the clamp-segments abut one another with mating side faces and the frustoconical surfaces are also mating, the rollers when they evenly contact the tubular are nearer the top end of the recess than the bottom. This provides maximum tolerance while still maintaining the strongest connections between the clamp-segments and sleeves. Of course, should the tubular be larger then it is possible that the rollers may be at the top of their recesses in contact with the tubular and yet the clamp-segments are not in mating contact side face to side face. This is still acceptable since the segments are wedged firmed between the mating cylindrical surfaces of the tubular and their interior surfaces and frusto-conical surfaces (in fact preferably inclined cylindrical) surfaces of the exterior surface of the clamp-segments and the bores of the sleeves.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1B:
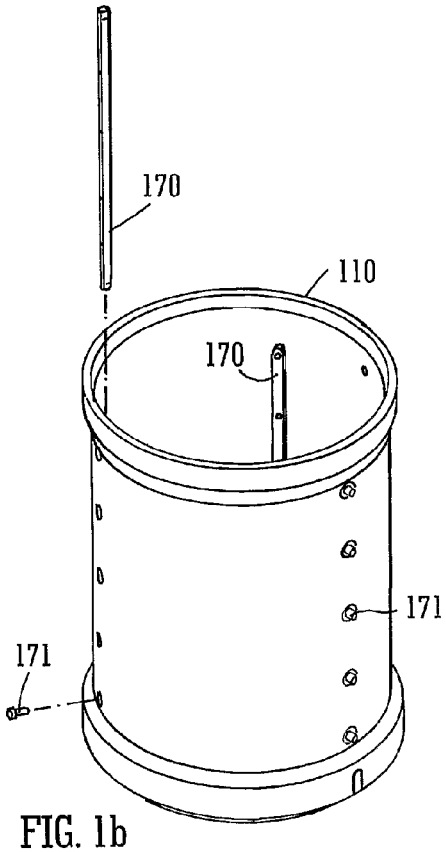
FIGS. 1*a, b* and *c* are respectively, a cutaway perspective view of a two-sleeve gripping tool in accordance with the present invention, a tubular housing, and an exploded view of the tool of FIG. 1*a;*

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Figure 1A:
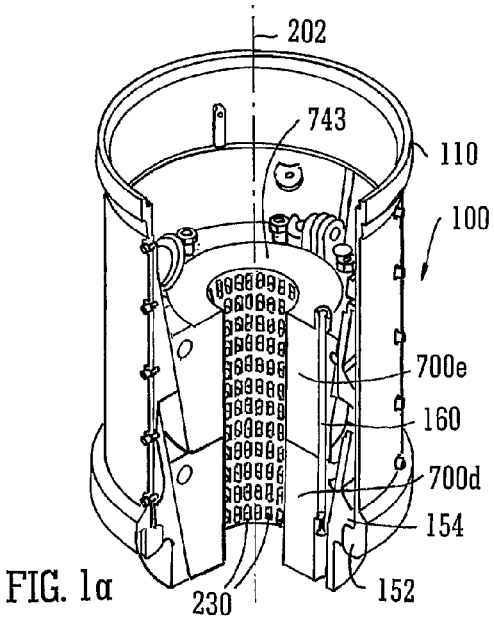
Figure 1C:
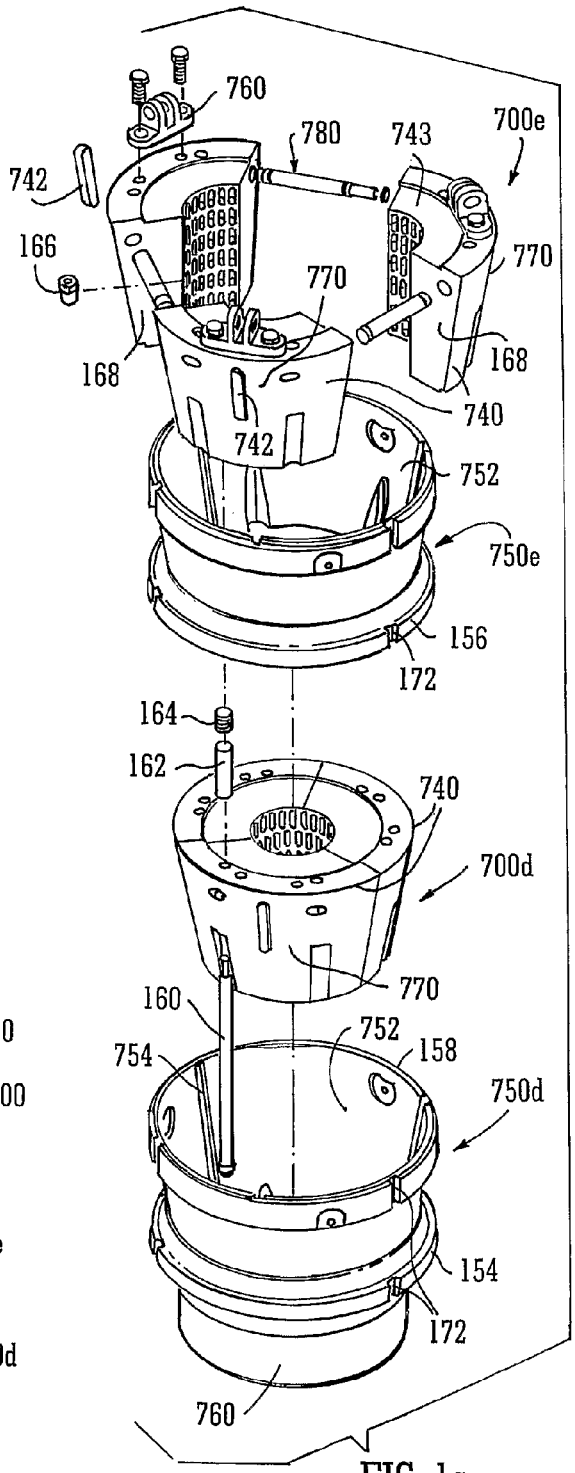

Referring to FIGS. 1*a* to *c*, illustrated are perspective views of at least a portion of an apparatus 100 according to one or more aspects of the present disclosure. The tool 100 comprises a tubular housing 110.

Figure 2:
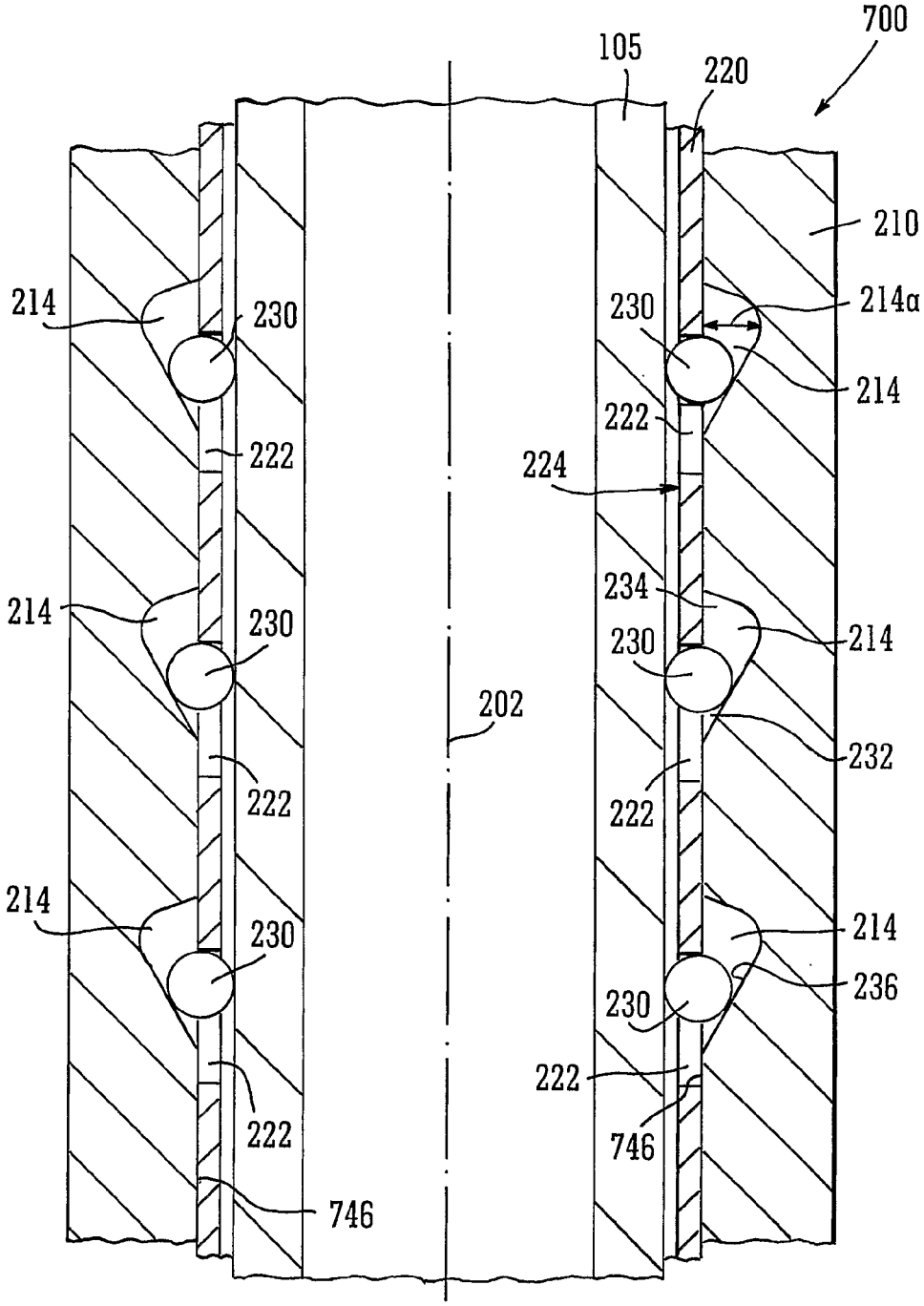
FIG. 2 is a side section illustrating general principle of operation of a tool according to the present invention.

Tool 100 is configured to receive and at least temporarily grip, frictionally engage, or otherwise retain a tubular member 105 (shown in FIG. 2). For example, the tool 100 may be configured to grip or otherwise frictionally engage an exterior surface of the tubular member 105. The extent to which the tool 100 engages the tubular member 105 may be sufficient to support a safe working load (SWL) of at least 5 tons. However, other SWL values for the tool 100 are also within the scope of the present disclosure.

Furthermore, the extent to which the tool 100 engages the tubular member 105 may also be sufficient to impart a torsional force to the tubular member 105, such as may be transmitted through a running tool (not shown) from a top drive or other component of a drill string (also not shown). In an exemplary embodiment, the torque which may be applied to the tubular member 105 via the tool 100 may be at least about 6700 Nm (about 5000 ft-lbs), which may be sufficient to "make-up" a connection between the tubular member 105 and another tubular member. The torque which may be applied to the tubular member 105 may additionally or alternatively be at least about 67,000 Nm (about 50,000 ft-lbs), which may be sufficient to "break" a connection between the tubular member 105 and another tubular member. However, other torque values are also within the scope of the present disclosure.

The tubular member in question may be a wellbore casing member, a drill string tubing member, a pipe member, a collared tubing member, and/or other tubular elements. The tubular member 105 may be a single tubular section, or pre-assembled double or triple sections. The tubular member 105 may be or comprise a section of a pipeline, such as may be utilized in the transport of liquid and/or fluid materials. The tubular member 105 may alternatively be or comprise one or more other tubular structural members. The tubular member may have an annulus cross-section having a substantially circular cylindrical shape, although approximations thereof may be engaged.

The tubular member 105 may not be dimensionally uniform or otherwise ideal. That is, the tubular member may not exhibit ideal roundness or circularity, such that all of the points on an outer surface of the tubular member 105 at a certain axial position may not form a perfect circle. Alternatively, or additionally, the tubular member 105 may not exhibit ideal cylindricity, such that all of the points of the outer surface may not be equidistant from a longitudinal axis 202 of the tool 100, and/or the tubular member 105 may not exhibit ideal concentricity, such that the axes of all cross sectional elements of the outer surface may not be common to the longitudinal axis 202.

Referring to FIG. 2, illustrated is a sectional view of at least a portion of an exemplary embodiment of a clamping member 700 of the tool 100 about a tubular member 105. The clamping member 700 includes a recessed member 210, a slotted or otherwise perforated cage member 220, and a plurality of rolling members 230.

Figure 5:
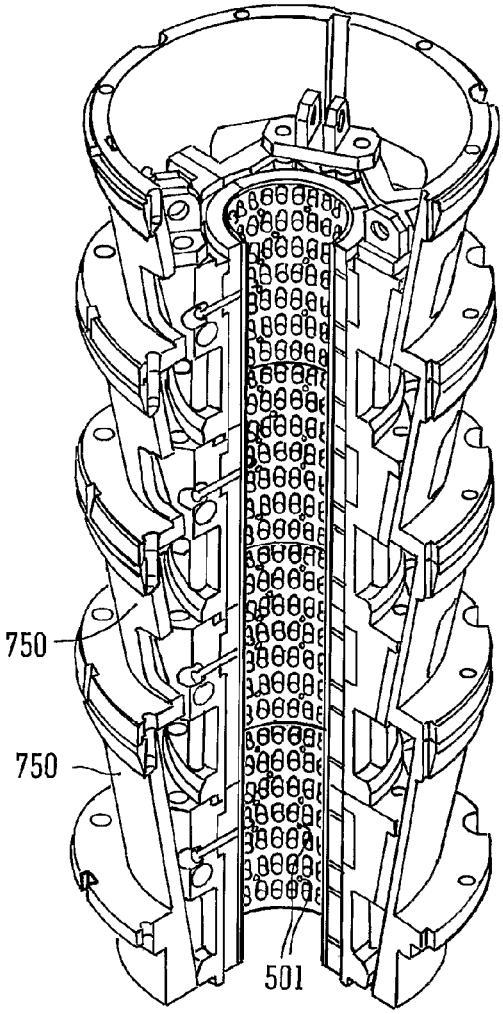
FIG. 5 is a perspective cutaway view of the tool of FIGS. 4*a* and *b*.

The recessed member 210 is substantially cylindrical when formed, having a plurality of recesses 214 therein. The cage member 220 is typically slotted with windows 222 but is not limited to such a configuration. The cage member 220 is fixed to the recessed member 210, preferably by screws (not shown, although see screws 501 in FIG. 5). Each slot or window 222 is configured to cooperate with one of the recesses 214 of the recessed member 210 to retain one of the rolling members 230. Moreover, each recess 214 and slot 222 is configured such that, when a rolling member 230 is moved further away from the maximum depth 214*a* of the recess 214 (that is, to a lower end 232 of the recess), the rolling member 230 protrudes further through the slot 222 and beyond an inner perimeter 224 of the slotted member 220, and when the rolling member 230 is moved towards the maximum depth 214*a* of the recess 214 (that is, to an upper end 234), the rolling member 230 also moves towards a retracted position within the inner perimeter 224 of the slotted member 220. That is to say, the bases 236 of the recesses are inclined with respect to the longitudinal axis 202 and are inclined inwardly and downwardly with respect to the normal orientation of the tool in use (which is as shown in FIG. 2).

Each slot 222 may have an oval or otherwise elongated profile, such that each slot 222 is greater in length than in width. The length of the slot 222 is in the direction of the longitudinal axis 202 of the tool 100. The walls of each slot 222 may be tapered radially inwardly.

Each recess 214 may have a width (into the page in FIG. 2) that is at least about equal to or slightly larger than the width or diameter of each rolling member 230. Each recess 214 may also have a length that is greater than a minimum length of the slot 222. The width or diameter of the rolling member 230 is at least larger than the width of the internal profile of the slot 222.

Because each slot 222 is elongated in the direction of the taper of the recesses 214, each rolling member 230 may protrude from the slotted member 220 an independent amount based on the proximate dimensional characteristics of the tubular member 105. For example, if the outer diameter of the tubular member 105 is smaller near the end 105*a* of the tubular member 105, the rolling member 230 located nearest the end 105*a* of the tubular member 105 protrudes from the slotted member 220 a greater distance relative to the distance which the rolling member 230 nearest the central portion of the tubular member 105 protrudes from the slotted member 220.

Each of the rolling members 230 may be or comprise a substantially spherical member, such as a steel ball bearing. However, other materials and shapes are also within the scope of the present disclosure. For example, each of the rolling members 230 may alternatively be a cylindrical or tapered pin configured to roll up and down the ramps defined by the recesses 214.

Figure 3:
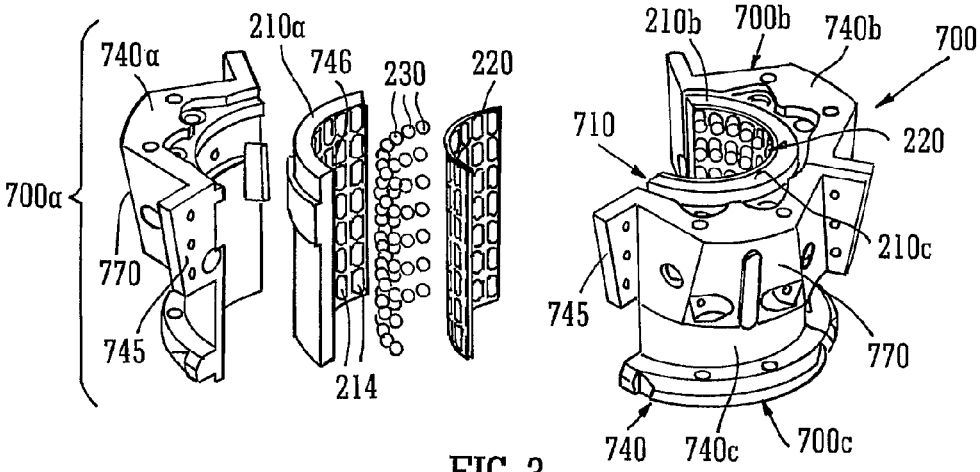
FIG. 3 is an exploded side view of a clamp segment and assembled view of two others forming a partially complete clamp member used in another embodiment of the present invention.

Referring to FIG. 3, illustrated is an exploded perspective view of the clamping member 700 of FIG. 2. From FIG. 3, it can be seen that the clamping member 700 actually comprises (in this embodiment) three clamping segments 700*a,b,c*, segment 700*a* of which is shown exploded and separated from the other two. From this it can also be seen that the slotted cage member 220 and recessed member 210 are likewise each in three segments.

The tool 100 also includes a holder 740 which also comprises three discrete sections 740*a,b,c*. Other functionally equivalent configurations may combine holders 740*a,b,c* and recessed member 210*a,b,c* to create an integral member in each case. Each holder section 740*a,b,c* may include a flange 745 configured to be coupled with a flange 745 of another of the holder sections 740*a,b,c*, such that the holder sections 740*a,b,c* may be assembled to form a bowl-type structure configured to hold the recessed sections 210*a,b,c* of the recessed member 210, as well as sections 220, and the rolling members 230.

Figure 4B:
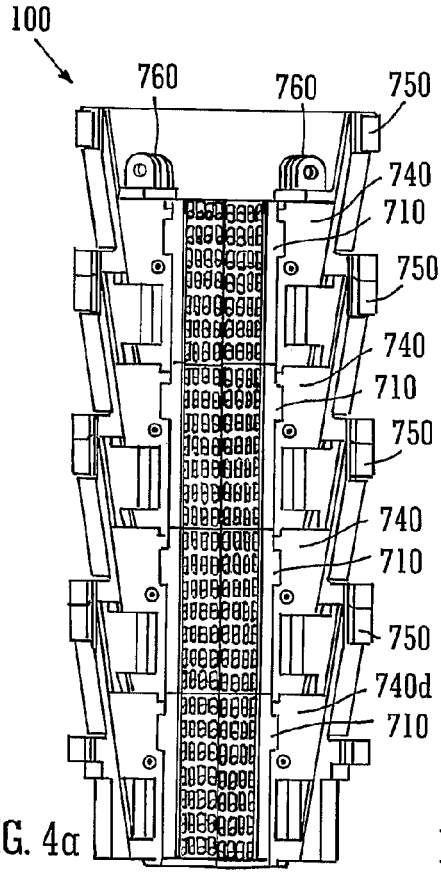
FIGS. 4*a* and *b* are side sections of a four-sleeve gripping tool using the clamp members of FIG. 3, FIG. 4*a* showing the tool in its closed or clamping position and FIG. 4*b* showing the tool open.
Figure 4B:
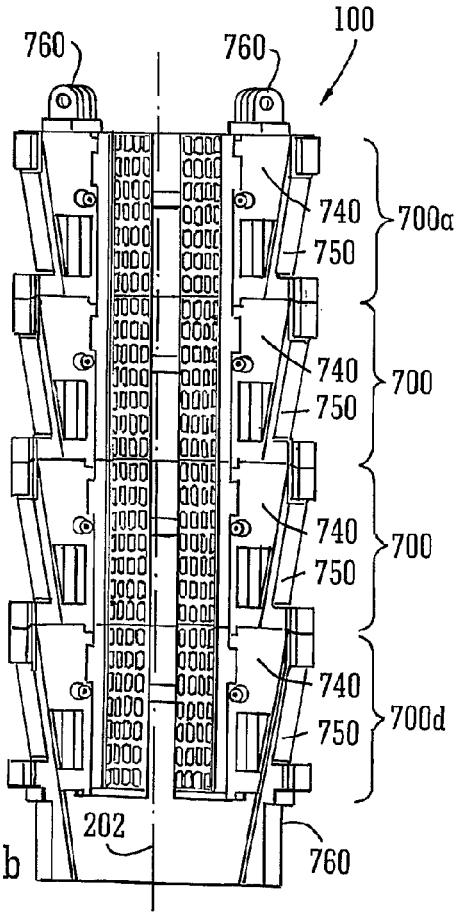

FIGS. 4A and 4B are side sectional views of the clamping member 700 shown in FIG. 3 in engaged and disengaged positions, respectively. Referring to FIGS. 4A and 4B collectively, with continued reference to FIG. 3, the tool 100 includes multiple clamping members 700 stacked vertically. Hereinafter, the clamping members 700 may also be referred to as vertical segments to reflect their vertically stacked arrangement. In the exemplary embodiment shown in FIGS. 4A and 4B, the apparatus 100 includes four vertical segments 700. In other embodiments, however, the apparatus may include fewer or more segments. The gripping force applied by the apparatus to the tubular member is at least partially proportional to the number of vertical segments (clamping members) 700, such that increasing the number of segments 700 increases the lifting capacity of the apparatus 100, as well as the torque which may be applied to the tubular member by the apparatus. Each of the vertical segments 700 may be substantially similar or identical, although the top and bottom segments 700 may have unique interfaces for coupling with additional equipment between a top drive (not shown), for instance, and the casing string. Indeed, bottom clamping member 700*d* is shown with an additional skirt 760 to receive bottom holder 740*d*, as described further below.

The external profile of each holder 740 is tapered at 770 in a frusto-conical fashion, (although, preferably, the frusto-cone is the special case of a circular cylinder and, instead, the axis of the cylindrical surface 770 is merely inclined towards (and so as to intersect) the longitudinal axis 202 of the tool), such that the lower end of each holder 740 has a smaller diameter than its upper end. Each vertical segment 700 of the apparatus 100 also includes a tubular housing sleeve 750 having an internal profile configured to cooperate with the external profile 770 of the holder 740 such that as the holder 740 moves downward (relative to the housing sleeve 750) towards the engaged, clamping, position (FIG. 4*a*) the holder 740 constricts radially inward. Yet, when the holder 740 moves upward, towards the disengaged position (FIG. 4*b*) the holder 740 expands radially outward.

The top segment 700*a* of the apparatus 100 may include an interface (hook eye) 760 configured to couple with one or more hydraulic cylinders and/or other actuators (not shown). Moreover, each holder 740 is coupled to its upper and lower neighboring holders 740. Consequently, vertical movement urged by the one or more actuators coupled to the interface 760 results in simultaneous vertical movement of all of the holders 740. Accordingly, downward movement of the holders 740 driven by the one or more actuators causes the rolling members 230 to engage the outer surface of the tubular member 105, whereas upward movement of the holders 740 driven by the one or more actuators causes the rolling members 230 to disengage the tubular member 105. The force applied by the one or more actuators to drive the downward movement of the holders 740 to engage the rolling members 230 with the tubular member 105 is one example of a preload that can be applied in order to pre-grip the tubular member 105 if gravity is not available to press the holder downwardly.

Referring back, now, to FIGS. 1*a, b* and *c*, tool 100 is a two-section tool, having two clamping members 700*d,e* vertically aligned. Tubular housing 110 here comprises a simple tube having a bottom internal flange 152 on which external flange 154 of bottom housing 750*d* seats. Bottom flange 156 of top housing 750*e* seats on top edge 158 of bottom housing 750*d*. A key 170 is fixed internally of the housing 110 by bolts 171 and slides in axially extending slots 172 on the outside of the housing sleeves 750*d,e*. Torque can then be transmitted by the housing 110 to the sleeves 750*d,e*.

Each vertically aligned holder 740 is interconnected by a pair of bolts 160. A spacer 162 and spring 164 being disposed between them and the connection being completed by a lock nut 166 that, when tightened, permits some relative vertical movement between holders 740. The purpose of this is to permit each clamping member 700*d,e* to independently clamp on the tubular member 105.

In use, tubular member 105 is inserted from underneath the tool 100. Prior to this, the holders 740 have been lowered into the tubular housing 110 and sleeves 750*d,e* so that they collapse inwardly to the clamping position depicted in FIG. 4*a* where radial faces 168 of adjacent holder sections 740*a,b,c* abut one another. In this position, the cage members 220 and internal face of the holders 740 (which here constitute also the recessed member 210 of FIG. 3 described above) are essentially on surfaces of the same cylinder. This cylinder coincides with the design cylinder of tubular members 105 the tool is intended to handle. However, when inserted from underneath, the tubular may not be absolutely true. Indeed, the internal frusto-conical surfaces of the housing sleeves 750*d,e* or the corresponding external surfaces 770 of the holders 740 might exhibit some tolerance. Finally, the pickup by the rollers 230 may also show some variation. These differences are to some extent accommodated and shared between the two clamp members 700*d,e* when a small freedom of movement between them is permitted, as provided by the bolts 160. Thus, when inserted from underneath and then the tubular housing 110 is lifted, the rollers 230 progressively bite into the tubular member 105. Some rollers 230 may not bite to the same extent as others, and the partial separation of the holders 740 permits some tolerance to be accommodated.

The holders have said frusto-conical external surfaces 770, as described above. These mate with corresponding frusto-conical internal surfaces 752 of the housing sleeves 750. The surfaces 770 include keys 742 that fit in slots 754 in the housing sleeves 750. If the surfaces 770,752 are truly conical, then they only mate in area contact in one axial position, which is arranged to be when the radial faces 168 of the holder sections 740*a,b,c* abut. In this event, as the holders 740 rise up, only a line contact remains between the surfaces 770,752. Accordingly, it is preferred, as stated above, that the engaging surfaces 770,752 are inclined cylindrical surfaces, in which event there is area contact in all axial positions. However, since there is only load applied when the holders 740 are in their clamp position, it is not a significantly important point. However, the keys 742 are preferably central in each holder 740. The keys 742 transmit torque between the housing sleeves 750 and the holders 740.

When a tubular member 105 is to be released by the tool 100, the weight of the tubular member 105 is taken from the tool 100 by other means (not shown). These means may simply comprise the tubular member 105 reaching a limit of travel after being lowered into a well bore. Alternatively, such means may comprise a floor slip arrangement (that may itself take the form of a tool according to the present invention). When the weight has been released, the holders 740 are lifted within the housing sleeve 750. When the holders 740 rise relative to the housing sleeves 750, springs 780 press the radial faces 168 apart. The tapered surfaces 770, 752 of the holders 740 and housing sleeves 750 allow the clamp segments to spread significantly, whereby not only is the tubular member 105 released, but also enlargements that may be in the tubular member 105 can pass through the tool 100. This is frequently the case in drill strings where connections between adjoining drill pipe sections may have an enlarged diameter.

The taper on the surfaces 770,752 is preferably about 15 degrees with respect to the longitudinal axis 202. Although shown much greater in FIG. 2, the inclination of the bases of the recesses 214 to the longitudinal axis is only about 10 degrees. The effect of this is that lifting the holders 740 immediately releases the clamping pressure without requiring significant force. Indeed, the arrangement is such that, in some applications, it is unnecessary to relieve the load of the tubular member 105 before releasing the tool 100. Such may be required in emergency situations. Indeed, umbilical connections between undersea installations and surface vessels often must be suddenly released and the present arrangement provides this capacity.

Figure 6:
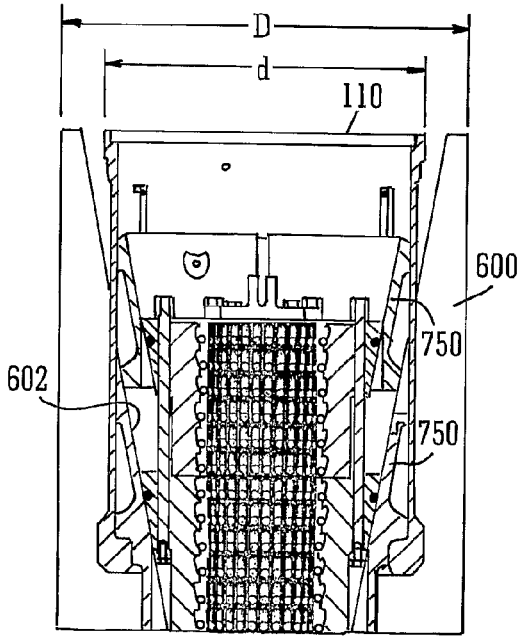
FIG. 6 is a side section illustrating a size benefit of a tool according to the present invention.

An advantage provided by dividing the clamping members 700 into short vertical sections is that the inclined surface needed to support a sufficiently long axial length for the holders 740 to attain sufficient grip on the tubular member 105 for the loads being envisaged can be provided in a relatively restrained diameter. FIG. 6 illustrates the profile 600 that a single vertical section tool would need to have if it were to have the same gripping power of a twin-section tool 100 as shown in FIGS. 1*a,b* and *c*. This is achieved simply by extending the taper 602 of the lower section as it would need to proceed if only a single clamp section was employed. Not only would this increase the dimensions of the tool (from diameter d to D in FIG. 6) but also the mass of the tool would commensurately be increased. Indeed, by constructing the housing from several components (the tubular housing 110 and housing sleeves 750) a particularly compact design is achieved, and one that is relatively easy to manufacture since there are few undercuts to be made.

Each holder section 740*a,b,c* therefore has said frustoconical external surface 770 (within the meaning of which is included inclined cylindrical or other approximation thereof) radial faces 168 (which in the arrangements illustrated are in radial planes, but this is not essential—therefore, the radial faces 168 may also be referred to as side faces) abutting end faces (see top face 743 in FIGS. 1*a* and *c* on which said lifting eyes 760 are fixed) and cylindrical and recessed internal face 746 (not visible except in FIGS. 2 and 3), which may be constituted in a separate component 210.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the scope of the present disclosure.

For example, embodiments of the invention, with suitable adaptation that would be evident to the person skilled in the art, have applications not limited to floor slips, handling apparatus and emergency disconnect devices.

In the case of floor slips, for example, the release of the tubular is easily and quickly effected by lifting the clamping members within the tubular housing sleeve. The spread of the individual segments on such lifting opens the aperture through the tool so that bulges and other flanges on the drill pipe or casing being controlled by the floor slip can pass through the tool without the need to open the tool and remove it laterally from the tubular.

In the case of handling equipment generally, or specifically for large pipe sections, for example, a simple tube or rod can be provided as a handle to be gripped by the tool of the present invention. Indeed, a flange can be disposed on the end of the handle in the event that the grip of the tool should falter or fail and whereby the flange will catch on the upper surface of the holder and press it into tighter engagement with the handle. In the locked position of the holder, the flange would be unable to pass through the tool, whereby a safety mechanism is provided. However, when the tool is released in normal operation by the holder being lifted in the housing sleeve, the spread of the clamping members opens the passage between them so that the flange on the handle could be accommodated to effect normal release (and engagement) of the tool from (and with) the handle.

In the case of emergency disconnect packages, the force needed to lift the holder is much less than the clamping force effect by the holder on the tubular it is gripping, whereby rapid disconnection is facilitated.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

REFERENCE NUMERALS

100—tool capable of lifting and applying torque
105—tubular abutment/tubular member
105*a*—end of tubular member 105
110—tubular housing (of tool 100)
152—bottom internal flange (of tubular housing 110)
154—external flange (of bottom housing 750*d*)
156—bottom flange (of top housing 750*e*)
158—top edge (of top housing 750*e*)
160—bolts (used in connecting vertically aligned holders 740)
162—spacer (used in connecting vertically aligned holders 740)
164—spring (used in connecting vertically aligned holders 740)
166—lock nut (used in connecting vertically aligned holders 740)
168—radial or side faces (of adjacent aligned holders 740)
170—key (of tubular housing 110)
171—bolts (affixing key 170 to tubular housing 110)
172—axially extending slots (on outside of housing sleeves 750*d,e*)
202—longitudinal axis (of tool 100)
210—recessed member (of clamping member 700)
210*a,b,c*—individual segments of recessed member 210
214—recesses (of recessed member 210)
214*a*—maximum depth of recesses 214
220—(slotted or otherwise) cage member (of clamping member 700)
222—windows/slots (of cage member 220)
224—perimeter of slotted member 220
230—rolling members (of clamping member 700)
232—lower ends of recesses 214
234—upper ends of recesses 214
236—bases of recesses 214
501—screws (fixing cage member 220 to recessed member 210)
700—clamping member/vertical segments
700*a,b,c*—individual segments of clamping member 700
700*d*—bottom clamping member/vertical segment
740—holder (of tool 100)
740*a,b,c*—discrete sections of holder 740
742—keys (of external surfaces 741 of holders 740)
743—top face or abutting end face of (top) holder 740
745—flange of each section 740*a,b,c* of holder 740
750—tubular housing sleeve (of each vertical segment 700)
750*d*—bottom tubular housing sleeve
750*e*—top tubular housing sleeve
752—frusto-conical external surfaces (of holders 740)
754—keys (of external surfaces 741 of holders 740)
760—skirt (of bottom clamping member 700*d*)
770—tapered, cylindrical, external profile (of each holder 740)
780—springs (that press radial faces 168 apart)

The invention claimed is:

1. A gripping tool in the form of a body having a longitudinal axis and formed by a plurality of sleeves connected end to end, each sleeve including a frusto-conical bore centered on said longitudinal axis;

a clamp member in each sleeve formed by clamp-segments, each having side faces, end faces, a frusto-conical exterior surface adapted to match said frusto-conical bore, and a cylindrical interior surface;

cage-segments connected to said interior surface and having a plurality of windows partially closing recesses in said interior surface, which each recess is elongate in said longitudinal direction, houses a roller and has a base inclined in said longitudinal direction so that, at a lower end of each recess the roller protrudes through said window and at an upper end thereof the roller protrudes less or not at all; and connection means between axially adjacent clamp segments so that they move together when one is moved axially, wherein each roller is a ball and each recess has a semicircular base of diameter substantially equal to the diameter of the ball.

2. A gripping tool as claimed in claim 1, wherein said connection means is a bolt passing longitudinally through axially adjacent clamp-segments and clamping them together axially.

3. A gripping tool as claimed in claim 1, wherein a top one each of said clamp-segments has a lift eye by which said clamp elements may be lifted with respect to said sleeves so that said clamp-segments slide up said frusto-conical bore separating from one another in a peripheral direction as they progress.

4. A gripping tool as claimed in claim 1, wherein a key on one of said frusto-conical surfaces slides in a groove in the other of said frusto-conical surfaces whereby torque applied to said sleeves is transmitted to said clamp-segments.

5. A gripping tool as claimed in claim 4, wherein said key and groove are parallel the cone angle of said frusto-conical surfaces.

6. A gripping tool as claimed in claim 5, wherein said key and groove are central in said clamp-segment between said side faces.

7. A gripping tool as claimed in claim 1, wherein there are three clamp-segments.

8. A gripping tool as claimed in claim 1, wherein said side faces are planar and disposed in radial planes with respect to said longitudinal axis.

9. A gripping tool as claimed in claim 1, wherein between a clamp position and an open position of the tool, the segments move from position in which the arcs of the cage segments lie in a common cylindrical surface and the frusto-conical surfaces are flush with each other, to a release position in which said side faces are spaced from one another and said frusto-conical surfaces have only line contact between them.

10. A gripping tool as claimed in claim 1, wherein said frusto-conical surfaces are part-cylindrical surfaces that are inclined towards said longitudinal axis.

11. A gripping tool as claimed in claim 1, wherein said sleeves are seated in a hollow housing tube.

12. A gripping tool as claimed in claim 11, wherein the housing tube and sleeves have between them a key whereby torque applied to the housing is transmitted to said sleeves.

13. A gripping tool as claimed in claim 11, wherein said housing tube has a cylindrical bore with an internal ledge at its bottom end, said sleeves being loaded from a top end, a bottom one seating on said ledge and succeeding ones seating on the one below.

14. A gripping tool as claimed in claim 1, wherein each recess base is inclined in said longitudinal direction by an angle of inclination with respect to the longitudinal axis, and wherein the angle of inclination with respect to the longitudinal axis of the frusto-conical surfaces is greater than the angle of inclination with respect to the longitudinal axis of each of the recess bases.

15. A gripping tool as claimed in claim 1, wherein the angle of inclination of the recess bases with respect to the longitudinal axis is between 3 and 10 degrees.

16. A gripping tool as claimed in claim 1, wherein the angle of inclination of the frusto-conical surfaces with respect to the longitudinal axis is between 10 and 20 degrees.

17. A gripping tool as claimed in claim 1, wherein tool is designed to clamp on tubular members whose diameter is such that, when the clamp-segments abut one another with mating side faces and the frusto-conical surfaces are also mating, the rollers when they evenly contact the tubular are nearer the top end of the recess than the bottom.

18. A gripping tool as claimed in claim 1, wherein each clamp member comprises a recessed member connected to a holder, wherein the holder provides said frusto-conical exterior surface and said recessed member provides said cylindrical interior surface.

19. A gripping tool as claimed in claim 18, wherein said recessed holder is a hardened component to resist the pressures applied by said rollers.

20. A gripping tool as claimed in claim 18, wherein said bias mechanism is a spring disposed between said side faces of the clamp segments.

21. A gripping tool as claimed in claim 1, wherein a bias mechanism urges said clamp-segments apart from each other in a peripheral direction.

22. A gripping tool as claimed in claim 1, wherein the angle of inclination of the frusto-conical surfaces with respect to the longitudinal axis is between 13 and 16 degrees and wherein the angle of inclination of the recess bases with respect to the longitudinal axis is between 5 and 8 degrees.

23. A gripping tool as claimed in claim 1, further comprising a bias mechanism, urging said clamp-segments apart from each other in a peripheral direction.

24. A gripping tool as claimed in claim 23, wherein said bias mechanism comprises a spring between each facing side face of adjacent clamp-segments.

25. A gripping tool as claimed in claim 24, wherein, when said lifting eyes are each attached to a lifting cable that lifts the clamp segments, the segments separate sufficiently to release any tubular clamped between the clamp-segments.

* * * * *